US008188370B2

(12) United States Patent
Fukuda et al.

(10) Patent No.: US 8,188,370 B2
(45) Date of Patent: May 29, 2012

(54) MULTILAYER INSULATED ELECTRIC WIRE AND TRANSFORMER USING THE SAME

(75) Inventors: Hideo Fukuda, Tokyo (JP); Yohei Ishii, Tokyo (JP); Hiroyuki Egawa, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 13/089,829

(22) Filed: Apr. 19, 2011

(65) Prior Publication Data

US 2011/0227691 A1 Sep. 22, 2011

Related U.S. Application Data

(63) Continuation of application No. PCT/JP2009/067811, filed on Oct. 14, 2009.

(30) Foreign Application Priority Data

Oct. 20, 2008 (JP) ..... 2008-270375
Feb. 2, 2009 (JP) ..... 2009-021938

(51) Int. Cl.
*H01B 7/00* (2006.01)

(52) U.S. Cl. ..... 174/120 SR; 174/110 SR

(58) Field of Classification Search ..... 336/65, 336/206–209; 174/120 AR, 120 SR, 110 R, 174/110 AR, 110 SR
See application file for complete search history.

(56) References Cited

U.S. PATENT DOCUMENTS 4,420,535 A * 12/1983 Walrath et al. ..... 428/379
5,606,152 A 2/1997 Higashiura et al.
6,222,132 B1 * 4/2001 Higashiura et al. ..... 174/120 R
6,525,272 B2 * 2/2003 Higashiura et al. ..... 174/120 R
8,008,578 B2 * 8/2011 Saito et al. ..... 174/110 R
2001/0010269 A1 * 8/2001 Higashiura et al. ..... 174/120 R
2010/0230133 A1 * 9/2010 Saito et al. ..... 174/120 C

FOREIGN PATENT DOCUMENTS

JP 62-193625 U 12/1987
JP 03-056112 U 5/1991
JP 06-223634 A 8/1994
JP 09-320356 A 12/1997
JP 10-223052 A 8/1998
JP 2002-324440 A 11/2002
JP 2004-193117 A 7/2004
JP 2004-281057 A 10/2004
JP 2004-335125 A 11/2004
JP 2007-005137 A 1/2007
JP 2008-071721 A 3/2008
JP 2008-198445 A 8/2008
WO 01/56041 A1 8/2001

* cited by examiner

*Primary Examiner* — Tuyen Nguyen
(74) *Attorney, Agent, or Firm* — Kubotera & Associates, LLC

(57) ABSTRACT

A multilayer insulated electric wire, containing:
a conductor; and
extruded insulation layers;
wherein an outermost layer (A) is composed of an extruded layer containing a thermoplastic polyester-series resin composition which contains 75 to 95 mass parts of a polyester resin other than a liquid crystal polyester, and 5 to 25 mass parts of a liquid crystal polyester,
wherein an innermost layer (B) and at least one insulating layer (C) between the outermost and innermost layers each are composed of an extruded layer containing a thermoplastic polyester resin, in which an entirety or a part of the thermoplastic polyester resin is formed by allowing an aliphatic alcohol component and an acid component to cause polycondensation, and in which the number of carbon atoms of the aliphatic alcohol component is 2 to 5.

8 Claims, 1 Drawing Sheet

MULTILAYER INSULATED ELECTRIC WIRE AND TRANSFORMER USING THE SAME

CROSS-REFERENCE TO RELATED APPLICATIONS

This is a continuation application of a prior PCT application No. PCT/JP2009/067811, filed on Oct. 14, 2009, pending, which claims priority of prior Japanese Patent applications No. 2008-270375, filed on Oct. 20, 2008 and No. 2009-021938, filed on Feb. 2, 2009.

TECHNICAL FIELD

The present invention relates to a multilayer insulated electric wire having an insulating layer composed of three or more extruded layers and a transformer using the same.

BACKGROUND ART

The construction of a transformer is prescribed by IEC (International Electrotechnical Communication) standards Pub. 60950, etc. Namely, these standards provide that at least three insulating layers be formed between primary and secondary windings (an enamel film which covers a conductor of a winding is not authorized as an insulating layer) or that the thickness of an insulating layer be 0.4 mm or more. The standards also provide that the creepage distance between the primary and secondary windings, which varies depending on applied voltage, be 5 mm or more, that the transformer withstands a voltage of 3,000 V, applied between the primary and secondary sides, for one minute or more, and the like.

According to such standards, as a currently prevailing transformer, a construction illustrated in a cross-section view of FIG. 2 has been adopted. Referring to FIG. 2, an enameled primary winding 4 is wound around a bobbin 2 on a ferrite core 1 in a manner such that insulating barriers 3 for securing the creepage distance are arranged individually on the opposite sides of the peripheral surface of the bobbin. An insulating tape 5 is wound for at least three turns on the primary winding 4, additional insulating barriers 3 for securing the creepage distance are arranged on the insulating tape, and an enameled secondary winding 6 is then wound around the insulating tape.

In recent years, however, a transformer having a structure that includes neither an insulating barrier 3 nor an insulating tape layer 5, as shown in FIG. 1, has been used instead of the transformer having the sectional structure shown in FIG. 2. The transformer shown in FIG. 1 has advantages in that the overall size thereof can be reduced compared to the transformer having the structure shown in FIG. 2 and that an operation of winding the insulating tape can be omitted.

In manufacturing the transformer shown in FIG. 1, it is necessary, in consideration of the aforesaid IEC standards, that at least three insulating layers 4*b* (6*b*), 4*c* (6*c*), and 4*d* (6*d*) are formed on the outer peripheral surface on one or both of conductors 4*a* (6*a*) of the primary winding 4 and the secondary winding 6.

As such a winding, there is known a structure in which an insulating tape is first wound around a conductor to form a first insulating layer thereon, and is further wound to form second and third insulating layers in succession, so as to form three insulating layers that are separable from one another. In addition, there is known a winding structure in which fluororesin in place of an insulating tape is successively extrusion-coated around a conductor to form three insulating layers in all (see, for example, Patent Literature 1).

In the above-mentioned case of winding an insulating tape, however, because winding the tape is an unavoidable operation, the efficiency of production is extremely low, and thus the cost of the electrical wire is conspicuously increased.

In addition, in the case of extruding fluororesin, there is an advantage in that the insulating layers have good heat resistance, because they are formed of fluororesin. However, there are problems in that, because of the high cost of the resin and the property that when it is pulled at a high shearing speed, the external appearance is deteriorated, it is difficult to increase the production speed, and the cost of the electric wire is increased as in the case of winding the insulating tape.

In attempts to solve such problems, a multilayer insulated electric wire is put to practical use and is manufactured by extruding a modified polyester resin, the crystallization of which has been controlled to inhibit a decrease in the molecular weight thereof, around a conductor to form first and second insulating layers, and polyamide resin extruded around the second insulating layer to form a third insulating layer (see, for example, Patent Literatures 2 and 3).

However, when the polyamide resin is extruded to form a third insulating layer, the surface of the electric wire formed by the polyamide resin is soft. Therefore, there is an issue of concern about sensitivity for scratches. Since it is used for electrical and electric parts, the ends of parts are scratched, which may cause failure. There is a need for a multilayer insulated electric wire which has sufficient elongation characteristics as an electric wire and the wire surface resistant to scratches.

CITATION LIST

Patent Literature

Patent Literature 1: JU-A-3-56112 ("JU-A" means unexamined published Japanese utility model registration application)

Patent Literature 2: U.S. Pat. No. 5,606,152

Patent Literature 3: JP-A-6-223634 ("JP-A" means unexamined published Japanese patent application)

DISCLOSURE OF INVENTION

Technical Problem

In order to solve the above problems, an object of the present invention is to provide a multilayer insulated electric wire satisfying heat resistance requirement, having sufficient elongation characteristics as an electric wire, being resistant to scratches due to the ends of parts, which is required as the use for coils, and having good processability without causing abnormality in external appearance on the surface of the film at the time of soldering. Further, another object of the present invention is to provide a transformer having excellent electric characteristics and high reliability which is obtained by winding such an insulated electric wire having heat resistance and elongation characteristics which does not form scratches easily.

Solution to Problem

The objects of the present invention have been achieved by the multilayer insulated electric wire and the transformer described below.

According to the present invention, there is provided the following means:

(1) A multilayer insulated electric wire, comprising:

a conductor; and three or more extruded insulation layers covering the conductor;

wherein an outermost layer (A) of the extruded layers is composed of an extruded layer containing a thermoplastic polyester-series resin composition which contains 75 to 95 mass parts of a polyester resin other than a liquid crystal polyester, and 5 to 25 mass parts of a liquid crystal polyester, wherein an innermost layer (B) of the extruded layers is composed of an extruded layer containing a thermoplastic polyester resin, in which an entirety or a part of the thermoplastic polyester resin is formed by allowing an aliphatic alcohol component and an acid component to cause polycondensation, and in which the number of carbon atoms of the aliphatic alcohol component is 2 to 5, and wherein at least one insulating layer (C) between the outermost layer and the innermost layer is composed of an extruded layer containing a thermoplastic polyester resin, in which an entirety or a part of the thermoplastic polyester resin is formed by allowing an aliphatic alcohol component and an acid component to cause polycondensation, and in which the number of carbon atoms of the aliphatic alcohol component is 2 to 5;

(2) The multilayer insulated electric wire as described in the above item (1), wherein the resin that forms the outermost layer (A) of the extruded layers is a resin mixture obtained by blending 1 to 20 mass parts of a reactive modifying resin having an epoxy group with 100 mass parts of the thermoplastic polyester-series resin composition;

(3) A multilayer insulated electric wire, comprising:

a conductor; and three or more extruded insulation layers covering the conductor;

wherein an outermost layer (A) of the extruded layers is composed of an extruded layer containing a polyester elastomer, in which polybutylene terephthalate resin (PBT) is used as a hard segment, wherein an innermost layer (B) of the extruded layers is composed of an extruded layer containing a thermoplastic polyester resin, in which an entirety or a part of the thermoplastic polyester resin is formed by allowing an aliphatic alcohol component and an acid component to cause polycondensation, and in which the number of carbon atoms of the aliphatic alcohol component is 2 to 5, and wherein at least one insulating layer (C) between the outermost layer and the innermost layer is composed of an extruded layer containing a thermoplastic polyester resin, in which an entirety or a part of the thermoplastic polyester resin is formed by allowing an aliphatic alcohol component and an acid component to cause polycondensation, and in which the number of carbon atoms of the aliphatic alcohol component is 2 to 5;

(4) The multilayer insulated electric wire as described in any one of the above items (1) to (3), wherein the thermoplastic polyester resin that forms the innermost layer (B) of the extruded layers is polybutylene terephthalate resin (PBT);

(5) The multilayer insulated electric wire as described in any one of the above items (1) to (3), wherein the thermoplastic polyester resin that forms the innermost layer (B) of the extruded layers is polyetylene terephthalate resin (PET);

(6) The multilayer insulated electric wire as described in any one of the above items (1) to (5), wherein the thermoplastic polyester resin that forms said at least one insulating layer (C) between the outermost layer and the innermost layer is polybutylene terephthalate resin (PBT);

(7) The multilayer insulated electric wire as described in any one of the above items (1) to (5), wherein the thermoplastic polyester resin that forms said at least one insulating layer (C) between the outermost layer and the innermost layer is polyetylene terephthalate resin (PET);

(8) The multilayer insulated electric wire as described in any one of the above items (1) to (3), (6) and (7), wherein the resin that forms the innermost layer (B) of the extruded layers is a resin mixture obtained by blending 1 to 20 mass parts of a reactive modifying resin having an epoxy group with 100 mass parts of the thermoplastic polyester resin formed by allowing the aliphatic alcohol component and the acid component to cause polycondensation;

(9) The multilayer insulated electric wire as described in any one of the above items (1) to (5) and (8), wherein the resin that forms said at least one insulating layer (C) between the outermost layer and the innermost layer is a resin mixture obtained by blending 1 to 20 mass parts of a reactive modifying resin having an epoxy group with 100 mass parts of the thermoplastic polyester resin formed by allowing the aliphatic alcohol component and the acid component to cause polycondensation; and

(10) A transformer, comprising the multilayer insulated electric wire as described in any one of the above items (1) to (9).

Advantageous Effects of Invention

The multilayer insulated electric wire of the present invention has a sufficient heat resistance level and excellent elongation characteristics and is resistant to scratches due to the ends of parts, which is required as the use for coils. Thus, the operability of the winding process is improved. The polyamide resin has been used for electric wires with heat resistance of Class E and there has been a problem such that the resin is sensitive for scratches. The multilayer insulated electric wire of the present invention can satisfy the above-described required items by using a specific polyester resin which is excellent in chemical resistance and elongation characteristics and is resistant to scratches for the outermost layer as an insulating layer, and using a combination of polyester resins for insulating layers other than the outermost layer and the innermost layer as well as the innermost layer.

The multilayer insulated electric wire can be directly subjected to soldering at the time of terminal processing, so that the operability of the winding processing is sufficiently improved. When the outermost layer is the polyamide resin, the smooth wire surface near a solder bath interface is deformed upon soldering, and thus a phenomenon causing abnormality in external appearance is occurred. Since a specific polyester resin has been used in place of the polyamide resin, water absorption into the layer is less than the case of the polyamide resin and the external appearance abnormality on the wire surface near the solder bath interface can be controlled.

Further, the transformer of the present invention using the multilayer insulated electric wire has excellent electric characteristics and high reliability.

Other and further features and advantages of the invention will appear more fully from the following description, appropriately referring to the accompanying drawings.

MODE FOR CARRYING OUT THE INVENTION

Figure 1:
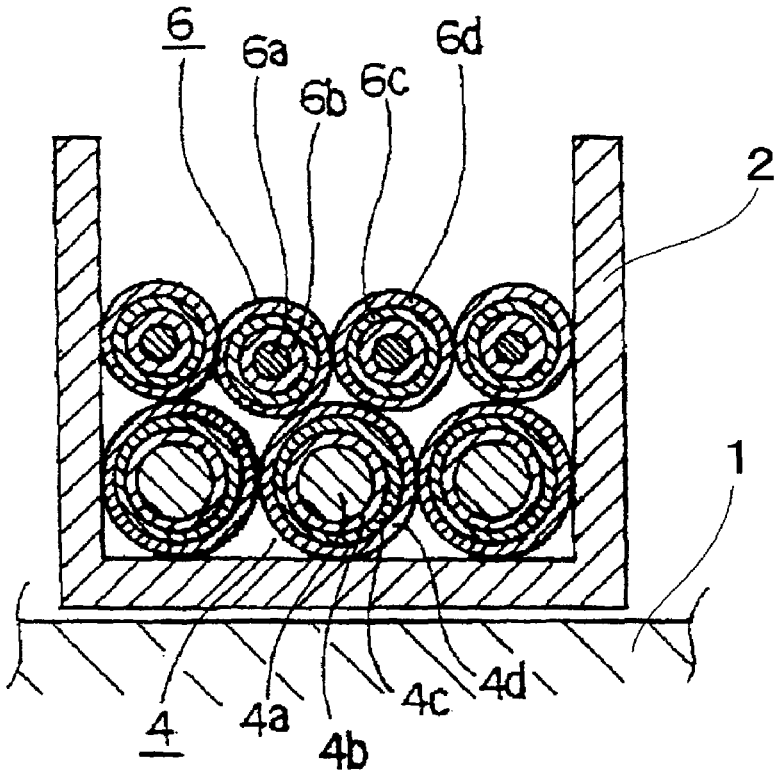
FIG. 1 is a cross-sectional view showing an example of a transformer having a structure in which a three-layer insulated electric wire is used as a winding.
Figure 2:
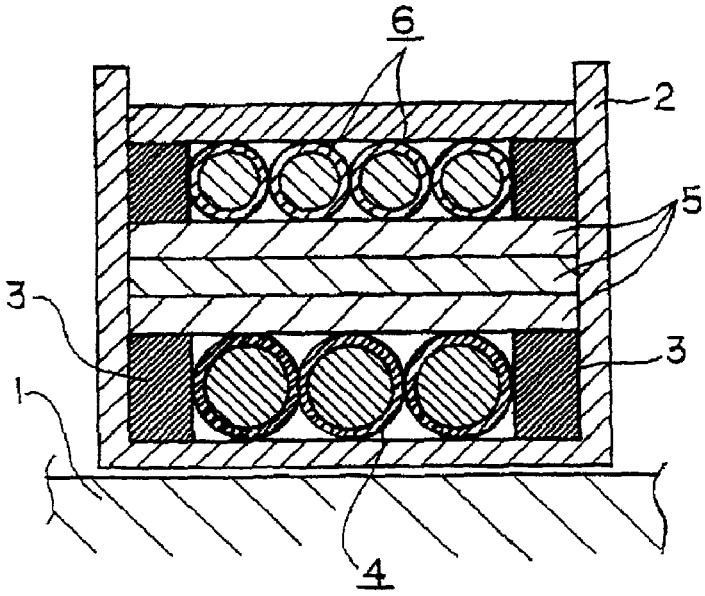
Fig. 2 Prior art
FIG. 2 is a cross-sectional view showing one example of a transformer having a conventional structure.

First, as for one preferred embodiment of a multilayer insulated electric wire of the present invention (hereinafter also referred to as a first embodiment), resins for constituting each layer will be described.

Since a resin which is excellent in solvent resistance and elongation characteristics and has a strong film strength is necessary for the outermost layer (A) of the insulated electric wire, the thermoplastic polyester resin is employed. Further, a resin having heat resistance, preferably a polyester resin containing a liquid crystal polyester, is used. When a liquid crystal polyester resin is used, heat resistance is dramatically improved. In the present invention, an insulating layer (A) is an extruded layer composed of a polyester-series resin obtained by blending the polyester resin other than liquid crystal polyesters with the liquid crystal polyester (for example, "Teijin PET" (trade name, manufactured by Teijin Ltd.), or "Unitika Rodrun" (trade name, manufactured by UNITIKA LTD.).

The molecular structure, density, molecular weight of the liquid crystal polyester that is used for the outermost layer (A) is not particularly limited, and a melt liquid-crystal type polyester (thermotropic liquid crystal polyester) which forms a liquid crystal when melted and has a melting point of 250° C. or more, preferably 280° C. or more, and less than about 350° C. is preferred. The upper limit temperature of liquid crystal phase is 380° C. The melt liquid-crystal type polyester is preferably a melt liquid-crystal type polyester copolymer. When the melting point of the liquid crystal polyester is too low, desired heat-resistant effects of the electric wire are not obtained, which is not preferable.

Examples of such melt liquid-crystal type polyesters include: (I) copolymerized polyesters which are obtained by block copolymerization of two kinds of rigid linear polyesters having a different chain length; (II) polyesters introduced with a non-linear structure, which are obtained by block copolymerization of a rigid linear polyester with a rigid non-linear polyester; (III) polyesters introduced with a flexible chain, which are obtained by copolymerization of a rigid linear polyester with a flexible polyester; and (IV) nucleus-substituted aromatic polyesters which are obtained by introducing a substituent on the aromatic ring of rigid linear polyesters.

Examples of repeating units of such polyesters include, but are not limited to, "a. those derived from aromatic dicarboxylic acids" and "b. those derived from aromatic diols", in addition to "c. aromatic hydroxycarboxylic acids".

a. Repeating Units Derived from Aromatic Dicarboxylic Acids:

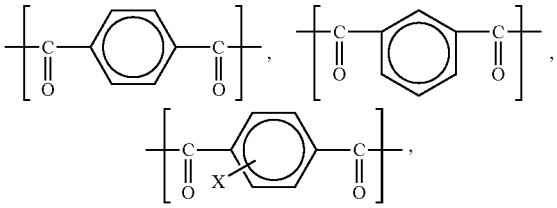

(X: halogen, alkyl, aryl)

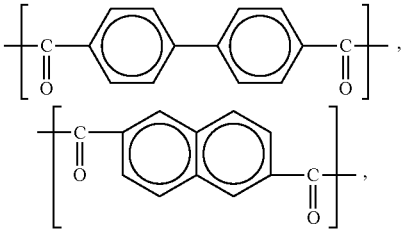

-continued

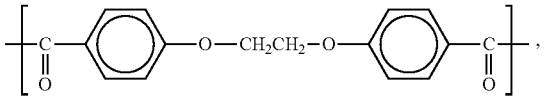

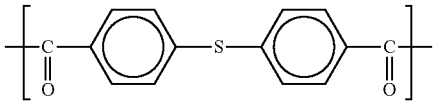

b. Repeating Units Derived from Aromatic Diols:

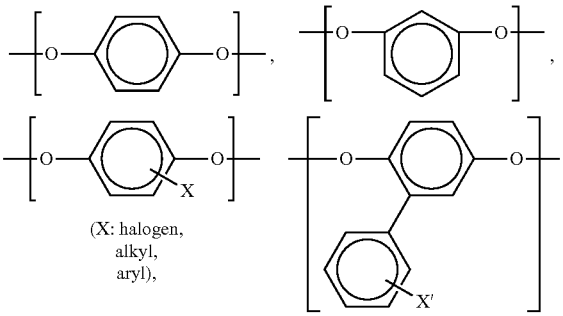

(X: halogen, alkyl, aryl), (X′: halogen, aryl),

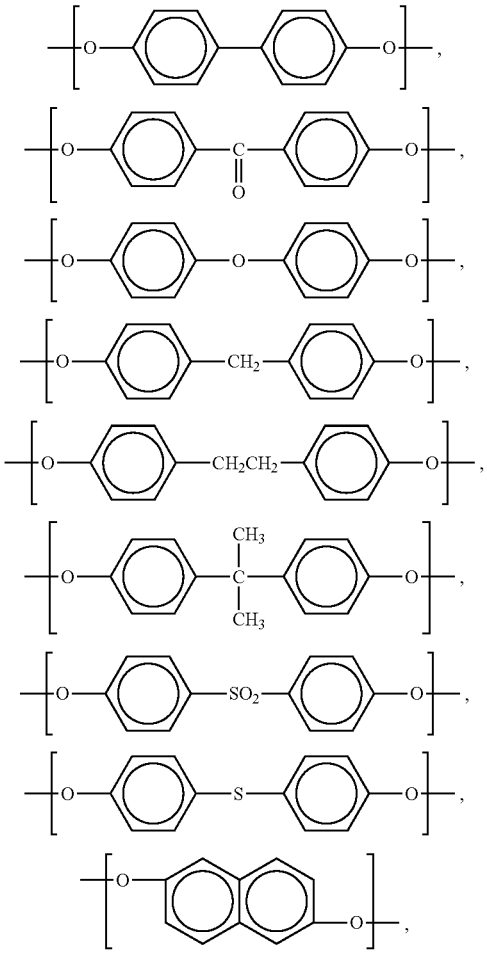

-continued

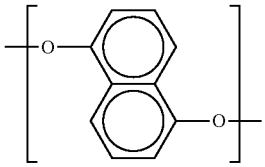

c. Repeating Units Derived from Aromatic Hydroxycarboxylic Acids:

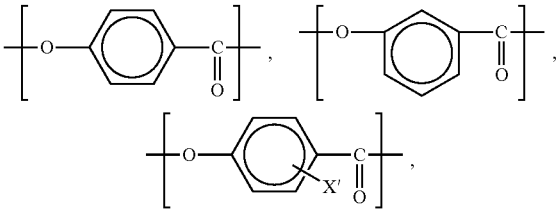

(X': halogen, alkyl)

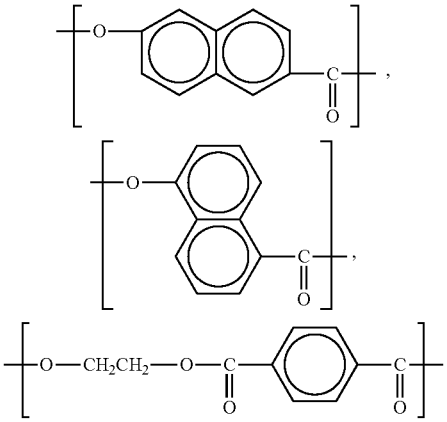

It is preferable from the standpoint of the balance among processability, heat resistance and mechanical properties in film-forming processes that the liquid crystal polymer for use in the present invention contains the following repeating unit; more preferably contains the following repeating unit in an amount of at least 30 mole %, with respect to the total repeating units.

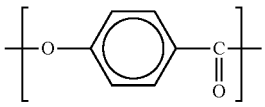

Preferable examples of the combination of repeating units constituting the liquid crystal polymer include the combinations (I) to (IV) described below.

(I)

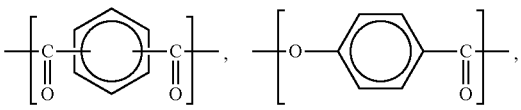

-continued

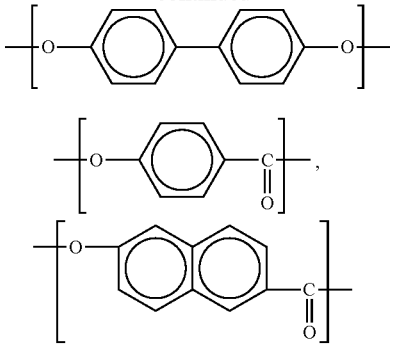

(II)

(III)

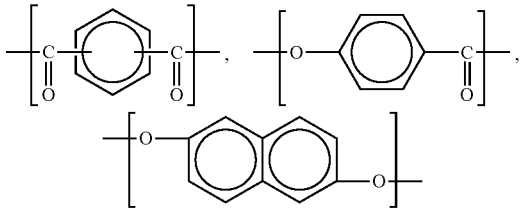

(IV)

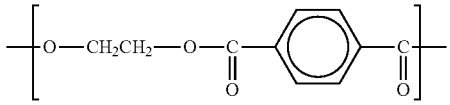

(V)

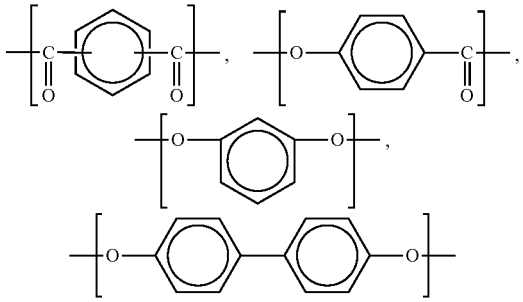

(VI)

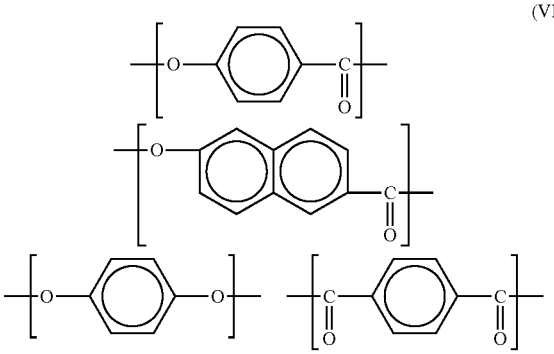

Methods for preparing such liquid-crystal polymers are disclosed in, for example, JP-A-2-51523, JP-B-63-3888 ("JP-B" means examined Japanese patent publication), and JP-B-63-3891.

Among them, the combinations shown in (I), (II) and (V) are preferable, and the combination shown in (V) is more preferable.

Because the liquid crystal polymer for use in the present invention has a flow temperature of more than 300° C. and a lower melt viscosity at melting than those of conventionally used polyethylene terephthalate or nylon 6,6, it can be extrusion-coated on a substrate at high speed, such that an insulating layer in film form can be prepared at low cost.

The liquid crystal polymer film is characteristic in that the elongation thereof is as extremely low as a few percent, and it has a problem in terms of flexibility. For this reason, according to the present invention, the liquid crystal polymer is blended with a polyester-based resin such as polybutylene terephthalate, polyethylene terephthalate or polyethylene naphthalate so as to improve the elongation of the film, thus improving the flexibility of the film.

In the present invention, the resin containing the liquid-crystal polyester for forming the insulating layer (A) contains 75 to 95 mass parts (preferably 80 to 90 mass parts) of the polyester resin other than the liquid-crystal polyester; and 5 to 25 mass parts (preferably 10 to 20 mass parts) of the liquid crystal polyester. When the content of the liquid-crystal polyester is too low, desired heat-resistant effects are not obtained. When the content is too high, elongation characteristics deteriorates and it is difficult to maintain the flexibility (bendability) of the electric wire.

Also, the mixing of the polyester resin other than the liquid crystal polyester with the liquid crystal polyester may be performed using any ordinary method.

In the present invention, the reactive modifying resin may be contained in the thermoplastic polyester-series resin composition containing the liquid crystal polyester and the polyester resin other than the liquid crystal polyester to improve the flexibility of the electric wire. For example, it may be a resin dispersion obtained by using a polyester-series resin to form a continuous layer and using the reactive modifying resin to form a dispersed phase. The content of the reactive modifying resin in the present invention is preferably 1 to 20 mass parts, more preferably 4 to 13 mass parts, based on 100 mass parts of polyester-series resin.

When the content of the reactive modifying resin is too high, the heat resistance is slightly deteriorated. When the content is too low, the effects of improving the flexibility may become insufficient in some cases. This is estimated that the heat resistance of the reactive modifying resin is lower than those of the liquid crystal polyester and the polyester resin other than the liquid crystal polyester.

This reactive modifying resin is the same as that to be used for the innermost layer (B) and the insulating layer (C) in another preferred embodiment to be described later and the details will be described later.

Subsequently, a second preferred embodiment of the present invention includes a polyester elastomer in which a polybutylene terephthalate resin (PBT) having excellent solvent resistance, excellent elongation characteristics, and heat resistance is used for the outermost layer (A) of the multilayer insulated electric wire as a hard segment.

A soft segment in the polyester elastomer produced by using the polybutylene terephthalate resin (PBT) as a hard segment is not particularly limited and arbitrary soft segments may be used. For example, an aliphatic polyether resin and an aliphatic polyester resin may be used as a soft segment. An example of such a polyester elastomer produced by using the polybutylene terephthalate resin (PBT) as such a hard segment and the aliphatic polyether resin as a soft segment includes "PELPRENE P-90B" (trade name, manufactured by Toyobo Co., Ltd.). An example of a polyester elastomer produced by using the polybutylene terephthalate resin (PBT) as a hard segment and the aliphatic polyester resin as a soft segment includes "PELPRENE S-9001" (trade name, manufactured by Toyobo Co., Ltd.).

A resin excellent in elongation characteristics and adhesion with a conductor as an extruded material is necessary to form the innermost layer (B) of the extruded layers of the multilayer insulated electric wire in the present invention. Preferably, the thermoplastic polyester resin is used for all or part of the layer.

The thermoplastic polymer resin used in the present invention is preferably a resin obtained by esterification (polycondensation) of either aromatic dicarboxylic acid or dicarboxylic acid, part of which is substituted with an aliphatic dicarboxylic acid, with an aliphatic diol. The number of carbon atoms of the aliphatic alcohol component is 2 to 5. Typical examples thereof may include polyethylene terephthalate resins (PET), polybutylene terephthalate resins (PBT), polyethylene naphthalate resins (PEN), cyclohexanedimethylene terephthalate (PCT) resins and the like.

The acid component used in the synthesis of the thermoplastic polyester resin is preferably an aromatic dicarboxylic acid; and examples thereof include terephthalic acid, isophthalic acid, terephthalic dicarboxylic acid, diphenylsulfonedicarboxylic acid, diphenoxyethanedicarboxylic acid, diphenylethercarboxylic acid, methylterephthalic acid, methylisophthalic acid and the like. Among them, terephthalic acid is particularly preferred.

As described above, a part of the aromatic dicarboxylic acid may be substituted with an aliphatic dicarboxylic acid; and examples thereof include succinic acid, adipic acid, sebacic acid and the like. The substitution amount of the aliphatic dicarboxylic acid is preferably less than 30 mole %, and particularly preferably less than 20 mole %, based on the aromatic dicarboxylic acid.

Meanwhile, the aliphatic alcohol component used in the esterification is preferably an aliphatic diol having 2 to 5 carbon atoms, and examples thereof include ethylene glycol, trimethylene glycol, tetramethylene glycol, pentanediol and the like. Among them, ethylene glycol and tetramethyl glycol are preferred.

In the present invention, a commercially available resin is employed as a resin that can be preferably used as the innermost layer (B) in any of the above-described embodiments. Examples thereof include polyethylene terephthalate (PET) such as "VYLOPET" (trade name, manufactured by Toyobo Co., Ltd.), "Bellpet" (trade name, manufactured by Kanebo, Ltd.), and "Teijin PET" (trade name, manufactured by Teijin Ltd.); polybuthylene terephthalate (PBT) resins such as "Novaduran" (trade name, manufactured by Mitsubishi Engineering-Plastics Corporation) and "Ultradur" (trade name, manufactured by BASF Japan); polyethylene naphthalate (PEN) resins such as "Teijin PEN" (trade name, manufactured by Teijin Ltd.); and polycyclohexanedimethylene terephthalate (PCT) resins such as EKTAR (trade name, manufactured by Toray Industries, Inc.).

It is preferable that at least one of the insulating layer (C) between the outermost layer and the innermost layer of the insulated electric wire (hereinafter also simply referred to as an insulating layer (C)) is excellent in adhesion of the outermost layer (A) and the innermost layer (B). Preferably, the thermoplastic polyester resin is used for all or part of the layer.

The thermoplastic polyester resin used in the present invention is preferably a resin obtained by esterification of either aromatic dicarboxylic acid or dicarboxylic acid, part of which is substituted with an aliphatic dicarboxylic acid, with an aliphatic diol. The number of carbon atoms of the aliphatic alcohol component is 2 to 5. Typical examples thereof may include polyethylene terephthalate resins (PET), polybutylene terephthalate resins (PBT), polyethylene naphthalate resins (PEN), polycyclohexanedimethylene terephthalate (PCT) resins and the like.

The acid component used in the synthesis of the thermoplastic polyester resin is preferably an aromatic dicarboxylic acid; and examples thereof include terephthalic acid, isophthalic acid, terephthalic dicarboxylic acid, diphenylsulfonedicarboxylic acid, diphenoxyethanedicarboxylic acid, diphenylethercarboxylic acid, methylterephthalic acid, methylisophthalic acid and the like. Among them, terephthalic acid is particularly preferred.

A part of the aromatic dicarboxylic acid may be substituted with an aliphatic dicarboxylic acid; and examples thereof include succinic acid, adipic acid, sebacic acid and the like. The substitution amount of the aliphatic dicarboxylic acid is preferably less than 30 mole %, and particularly preferably less than 20 mole %, based on the aromatic dicarboxylic acid.

Meanwhile, the aliphatic alcohol component used in the esterification is preferably an aliphatic diol having 2 to 5 carbon atoms; and examples thereof include ethylene glycol, trimethylene glycol, tetramethylene glycol, pentanediol and the like. Among them, ethylene glycol and tetramethyl glycol are preferred.

In the present invention, a commercially available resin is employed as a resin that can be preferably used as the insulating layer (C). Examples thereof include polyethylene terephthalate (PET) resins such as "VYLOPET" (trade name, manufactured by Toyobo Co., Ltd.), "Bellpet" (trade name, manufactured by Kanebo, Ltd.), and "Teijin PET" (trade name, manufactured by Teijin Ltd.); polybuthylene terephthalate (PBT) resins such as "Novaduran" (trade name, manufactured by Mitsubishi Engineering-Plastics Corporation) and "Ultradur" (trade name, manufactured by BASF Japan); polyethylene naphthalate (PEN) resins such as "Teijin PEN" (trade name, manufactured by Teijin Ltd.); and polycyclohexanedimethylene terephthalate (PCT) resins such as EKTAR (trade name, manufactured by Toray Industries, Inc.).

In the present invention, the thermoplastic polyester resin which is used for the innermost layer (B) and the insulating layer (C) may be used alone. As the second embodiment, it is preferable that the reactive modifying resin having an epoxy group is added in addition to the thermoplastic polyester resin from the viewpoint of improving the flexibility of the electric wire. Here, the reactive modifying resin means the resin having an epoxy group. That is, the reactive modifying resin is a resin which is modified so as to have an epoxy group and in which the reactivity with a polyester resin is improved.

The epoxy group is a functional group having reactivity with the polyester resin. The epoxy group is blended and mixed with the polyester resin and a resin mixture is formed by their reactions. The epoxy group is chemically bound to the polyester resin by the ring opening of the epoxy group and the reaction is progressed. The content of the monomer component containing an epoxy group in the resin having an epoxy group is preferably 20 mass % or less, more preferably 15 mass % or less. As such a resin, a copolymer which contains a compound component containing an epoxy group is preferred. As a compound containing an epoxy group which gives a polymer having reactivity, for example, a glycidyl ester compound of an unsaturated carboxylic acid represented by the following formula (1) is included.

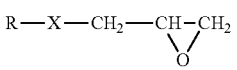

Formula (1)

[In formula (1), R represents an alkenyl group having 2 to 18 carbon atoms; and X represents a carbonyloxy group.]

Specific examples of the glycidy ester of an unsuturated calboxylic acid include glycidyl acrylate, glycidyl methacrylate, and glycidyl itaconate. Among them, glycidyl methacrylate is preferable.

Typical examples of resins that have reactivity with the polyester resin (reactive modifying resin) include ethylene/glycidyl methacrylate, ethylene/glycidyl methacrylate/vinyl acetate, and ethylene/glycidyl methacrylate/methyl acrylate. Examples of commercially available resin of the reactive modifying resin may include Bondfast (trade name, manufactured by Sumitomo Chemical Co., Ltd.) and LOTADER (trade name, manufactured by ATOFINA Chemicals, Inc.). For example, in the case of the compound of the formula (1), the epoxy group is chemically bound to a —OH group and a —COOH group present in the end of the polyester resin by the ring opening of the epoxy group, and a bond of ═C(OH)—$CH_2$—O— and a bond of ═C(OH)—$CH_2$—OCO— are formed. The flexibility is improved by the progress of the reaction as compared with the case of using the polyester resin alone. In the present invention, the polyester resin is kneaded with the reactive modifying resin in advance before producing the insulated electric wire, so that the reactive modifying resin is well dispersed in the polyester resin. Particularly, even if an initiator is not used, the reaction is performed under a temperature when extrusion.

In the preferred embodiment, the innermost layer (B) or the insulating layer (C) is obtained by blending 1 to 20 mass parts of a resin having an epoxy group with 100 mass parts of the thermoplastic polyester resin formed by allowing the aliphatic alcohol component and the acid component to cause polycondensation. When the blending amount of the resin having an epoxy group is too large, the heat resistance of the insulating layer is significantly reduced. When it is too small, the effects of improving the flexibility are not exhibited. A preferable blending ratio of the epoxy group is 1 to 15 mass parts based on 100 mass parts of the thermoplastic polyester resin.

Other heat resistant resins, usually-used additives, inorganic fillers, processing aids, colorants or the like may be added to the resin constituting each insulating layer in the present invention in a range without impairing the desired characteristics.

The multilayer insulating layer in the present invention is not limited to the three layers. In addition to the insulating layer (C), an insulating layer composed of liquid crystal polyester, polyphenylene sulfide, polyether sulphone or the like may be formed as an interlayer to further improve the heat resistance.

As the conductor to be used for the present invention, a metal bare wire (singlet), an insulated electric wire obtained by forming an enameled layer or a thin-walled insulating layer on a metal bare wire, or a multi-stranded wire obtained by twisting a plurality of metal bare wires or a plurality of an enamel-insulated electric wires or thin-walled insulated electric wires may be used. The number of stranded wires in the wire may be optionally selected depending on the high-frequency application. When the number of wires of a core wire (element wire) is large (for example, a 19- or 37-element wire), the core wire may be in a form of a non-stranded wire. In the case of the non-stranded wire, for example, a plurality of electric wires may be gathered together to bundle up them in an approximately parallel direction, or the bundle of them may be intertwined in a very large pitch. In each case, it is preferable that the cross section thereof has almost a circular shape.

The multilayer insulated electric wire of the present invention is produced by sequential extrusion of insulating layers in an ordinary manner in which a first insulating layer is formed with a desired thickness around the conductor and then a second insulating layer is formed with a desired thickness around the first insulating layer. The whole thickness of the extruded layers formed in this manner is preferably set to within a range of 50 to 180 μm in the case of three layers. This is because when the whole thickness of the insulating layers is too thin, electric characteristics of the obtained multilayer insulated electric wire having heat resistance are largely reduced and may be unsuitable for practical use. To the contrary, when the thickness is too thick, it is unsuitable for miniaturization and coil processing may become difficult. More preferably, the range is 60 to 150 μm. It is preferable that the thickness of each of the three layers is set to 10 to 60 μm.

As the embodiment of the transformer using the above-described multilayer insulated electric wire, a structure in which the primary winding 4 and the secondary winding 6 are formed without incorporating the insulating barrier and the insulating tape layer in the bobbin 2 on the ferrite core 1, as shown in FIG. 1, is preferred. The multilayer insulated electric wire of the present invention may be applied to other types of arbitrary transformers.

EXAMPLES

The present invention will be described in more detail based on examples given below, but the invention is not meant to be limited by these.

Examples 1 to 13 and Comparative Examples 1 to 4

As conductors, annealed copper wires having a diameter of 1.0 mm were provided. Each resin shown in Table 1 was used as a resin for extrusion of each layer at the indicated proportion (the numerical value of the composition is a value in terms of mass parts). The innermost layer (B), the insulating layer (C) between the outermost layer and the innermost layer, and the outermost layer (A), in this order, were sequentially extrusion-coated on a conductor to produce a multilayer insulated electric wire having a thickness indicated in Table 1 (100 or 60 μm).

Each of the resins in Table 1 is described in detail below.

LCP Resin: "Rodrun"
(trade name, manufactured by UNITIKA LTD.),
Liquid Crystal Polyester Resin PBT Resin: "Novaduran"
(trade name, manufactured by Mitsubishi Engineering-Plastics Corporation)
Polybuthylene Terephthalate Resin PET Resin: "Teijin PET"
(trade name, manufactured by Teijin Ltd.),
Polyethylene Terephthalate Resin Reactive Modifying Resin: "Bondfast 7M"
(trade name, manufactured by Sumitomo Chemical Co., Ltd.),
Epoxy Group-Containing Resin PBT Elastomer: "PELPRENE S-9001"
(manufactured by Toyobo Co., Ltd.),
Polyester Elastomer Resin Poly Amide Resin: "FDK-1"
(trade name, manufactured by UNITIKA LTD.),
Polyamide 66 Resin As for each of the obtained multilayer insulated electric wires, various kinds of characteristics were examined by the following methods. The external appearance was observed with the bare eye. The obtained results are shown in Table 1.

A. Determination of Scratch Degree of Wire Surface:

The wire surface is visually examined whether the film is peeled such that the conductor appears when the wire surface is rubbed once with the edge of the nail by imitating the separating claw method described in Solvent-resistant material (1) in JIS C 3003-1984 14.

When slight peeling of the surface layer was observed, it was represented as "coat peeling". When no peeling was observed, it was evaluated as "good".

B. Electric Heat Resistance:

The heat resistance was evaluated by the following test method, in conformity to Annex U (Electric wires) of Item 2.9.4.4 and Annex C (Transformers) of Item 1.5.3 of 60950-standards of the IEC standards.

Ten turns of the multilayer insulated electric wires were wound around a mandrel with a diameter of 10 mm under a load of 118 MPa (12 kg/mm$^2$). They were heated for 1 hour at 215° C., and then for additional 21 hours at 140° C. and 3 hours at 190° C., and then they were kept in an atmosphere of 30° C. and humidity 95% for 48 hours. Thereafter, a voltage of 3,000 V was applied thereto for 1 minute. When there was no electrical short-circuit, it was considered that it passed Class E. (The judgment was made with n=5. It was considered that it did not pass the test even when one is judged as NG.)

Similarly, the multilayer insulated electric wires were wound around a mandrel. They were heated for 1 hour at 225° C., and then for additional 21 hours at 150° C. and 3 hours at 200° C., and then they were kept in an atmosphere of 30° C. and humidity 95% for 48 hours. Thereafter, a voltage of 3,000 V was applied thereto for 1 minute. When there was no electrical short-circuit, it was considered that it passed Class B. (The judgment was made with n=5. It was considered that it did not pass the test even when one is judged as NG.)

C. Solvent Resistance

The electric wire subjected to 20D winding was dipped in ethanol or isopropyl alcohol for 30 seconds and dried. Then, the surface of the sample was observed to judge whether crazing occurred or not. No crazing was observed in all the samples, so they were represented as "○ (good)".

It was determined whether each sample was passed or failed as an insulated electric wire based on the total of the test results of A, B, and C. A preferable sample was designated as "○ (passed)" and an unsuitable sample was designated as "x (failed)".

TABLE 1

| | | Example | | | | | | | | |
|---|---|---|---|---|---|---|---|---|---|---|
| | | 1 | 2 | 3 | 4 | 5 | 6 | 7 | 8 | 9 |
| Layer (A) *1 | LCP resin | 15 | 15 | 15 | 15 | 15 | 15 | 13 | 13 | 13 |
| | PBT resin | — | — | — | — | — | — | — | — | — |
| | PET resin | 85 | 85 | 85 | 85 | 85 | 85 | 82 | 82 | 82 |
| | RMR *4 | — | — | — | — | — | — | 5 | 5 | 5 |
| | Elastomer *5 | — | — | — | — | — | — | — | — | — |
| | PA resin *6 | — | — | — | — | — | — | — | — | — |

TABLE 1-continued

| | | | | | | | | | | |
|---|---|---|---|---|---|---|---|---|---|---|
| Layer (C) | PBT resin | 100 | — | — | 100 | 100 | — | 100 | 100 | — |
| *2 | PET resin | — | 100 | 100 | — | — | 90 | — | — | 90 |
| | RMR *4 | — | — | — | — | — | 10 | — | — | 10 |
| Layer (B) | PBT resin | 100 | — | 100 | — | 100 | — | 100 | 100 | — |
| *3 | PET resin | — | 100 | — | 100 | — | 90 | — | — | 90 |
| | RMR *4 | — | — | — | — | — | 10 | — | — | 10 |
| Total thickness [μm] | | 100 | 100 | 100 | 100 | 60 | 100 | 100 | 60 | 100 |
| Scratch test | | good | good | good | good | good | good | good | good | good |
| Class E *7 | | — | — | — | — | — | — | — | — | — |
| Class B *8 | | pass | pass | pass | pass | pass | pass | pass | pass | pass |
| External | Xylene | ○ | ○ | ○ | ○ | ○ | ○ | ○ | ○ | ○ |
| appearance | Styrene | ○ | ○ | ○ | ○ | ○ | ○ | ○ | ○ | ○ |
| abnormality *9 | IPA *10 | ○ | ○ | ○ | ○ | ○ | ○ | ○ | ○ | ○ |
| Passing status | | ○ | ○ | ○ | ○ | ○ | ○ | ○ | ○ | ○ |

| | | Example | | | | Comparative example | | | |
|---|---|---|---|---|---|---|---|---|---|
| | | 10 | 11 | 12 | 13 | 1 | 2 | 3 | 4 |
| Layer (A) | LCP resin | — | — | 15 | 13 | — | — | — | — |
| *1 | PBT resin | — | — | 85 | 82 | — | — | 100 | — |
| | PET resin | — | — | — | — | — | — | — | 90 |
| | RMR *4 | — | — | — | 5 | — | — | — | 10 |
| | Elastomer *5 | 100 | 100 | — | — | — | — | — | — |
| | PA resin *6 | — | — | — | — | 100 | 100 | — | — |
| Layer (C) | PBT resin | 100 | — | 100 | 100 | — | 100 | 100 | — |
| *2 | PET resin | — | 90 | — | — | 90 | — | — | 90 |
| | RMR *4 | — | 10 | — | — | 10 | — | — | 10 |
| Layer (B) | PBT resin | 100 | — | 100 | 100 | — | 100 | 100 | — |
| *3 | PET resin | — | 90 | — | — | 90 | — | — | 90 |
| | RMR *4 | — | 10 | — | — | 10 | — | — | 10 |
| Total thickness [μm] | | 100 | 100 | 100 | 100 | 100 | 100 | 100 | 100 |
| Scratch test | | good | good | good | good | coat peeling | coat peeling | good | good |
| Class E *7 | | — | — | pass | pass | pass | pass | fail | fail |
| Class B *8 | | pass | pass | — | — | — | — | — | — |
| External | Xylene | ○ | ○ | ○ | ○ | ○ | ○ | ○ | ○ |
| appearance | Styrene | ○ | ○ | ○ | ○ | ○ | ○ | ○ | ○ |
| abnormality *9 | IPA *10 | ○ | ○ | ○ | ○ | ○ | ○ | ○ | ○ |
| Passing status | | ○ | ○ | ○ | ○ | x | x | x | x |

*1 Outermost layer (A)
*2 Layer (C) between Outermost layer and Innermost layer
*3 Innermost layer (B)
*4 Reactive modifying resin
*5 PBT elastomer
*6 Polyamide resin
*7 Electric heat resistance [Class E]
*8 Electric heat resistance [Class B]
*9 Presence or absence of external appearance abnormality of electric wire after solvent treatment
*10 Isopropyl alcohol The results shown in Table 1 revealed the following.

In Comparative Examples 1 and 2 in which the outermost layer (A) was coated with the polyamide resin, the film was peeled such that the conductor appeared as the result of the scratching test. In Comparative Examples 3 and 4, the samples did not satisfy the heat resistance Class E. On the other hand, in Examples 1 to 11, the scratching test, the electric heat resistance (Class B), the solvent resistance all satisfied the standards. In Examples 12 and 13, the electric heat resistance (Class E) was satisfied in addition to the scratching test and the solvent resistance.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-270375 filed in Japan on Oct. 20, 2008, and Patent Application No. 2009-021938 filed in Japan on Feb. 2, 2009, each of which is entirely herein incorporated by reference.

REFERENCE SIGNS LIST

1 Ferrite core
2 Bobbin
3 Insulating barrier
4 Primary winding
4*a* Conductor
4*b*, 4*c*, 4*d* Insulating layers
5 Insulating tape
6 Secondary winding
6*a* Conductor
6*b*, 6*c*, 6*d* Insulating layers

The invention claimed is:

1. A multilayer insulated electric wire, comprising:

a conductor; and three or more extruded insulation layers covering the conductor, wherein an outermost layer (A) of the extruded layers is composed of an extruded layer containing a polyester elastomer, in which polybutylene terephthalate resin is used as a hard segment, wherein an innermost layer (B) of the extruded layers is composed of an extruded layer containing a thermoplastic polyester resin, in which an entirety or a part of the thermoplastic polyester resin is formed by allowing an aliphatic alcohol component and, an acid component to cause polycondensation, and in which the number of carbon atoms of the aliphatic alcohol component is 2 to 5, and wherein at least one insulating layer (C) between the outermost layer and the innermost layer is composed of an extruded layer containing a thermoplastic polyester resin, in which an entirety or a part of the thermoplastic polyester resin is formed by allowing an aliphatic alcohol component and an acid component to cause polycondensation, and in which the number of carbon atoms of the aliphatic alcohol component is 2 to 5.

2. The multilayer insulated electric wire according to claim 1, wherein the thermoplastic polyester resin that forms the innermost layer (B) of the extruded layers is polybutylene terephthalate resin.

3. The multilayer insulated electric wire according to claim 1, wherein the thermoplastic polyester resin that forms the innermost layer (B) of the extruded layers is polyetylene terephthalate resin.

4. The multilayer insulated electric wire according to claim 1, wherein the thermoplastic polyester resin that forms said at least one insulating layer (C) between the outermost layer and the innermost layer is polybutylene terephthalate resin.

5. The multilayer insulated electric wire according to claim 1, wherein the thermoplastic polyester resin that forms said at least one insulating layer (C) between the outermost layer and the innermost layer is polyetylene terephthalate resin.

6. The multilayer insulated electric wire according to claim 1, wherein the resin that forms the innermost layer (B) of the extruded layers is a resin mixture obtained by blending 1 to 20 mass parts of a reactive modifying resin having an epoxy group with 100 mass parts of the thermoplastic polyester resin formed by allowing the aliphatic alcohol component and the acid component to cause polycondensation.

7. The multilayer insulated electric wire according to claim 1, wherein the resin that forms said at least one insulating layer (C) between the outermost layer and the innermost layer is a resin mixture obtained by blending 1 to 20 mass parts of a reactive modifying resin having an epoxy group with 100 mass parts of the thermoplastic polyester resin formed by allowing the aliphatic alcohol component and the acid component to cause polycondensation.

8. A transformer, comprising the multilayer insulated electric wire according to claim 1.

* * * * *